US006201044B1

(12) United States Patent
Moore et al.

(10) Patent No.: US 6,201,044 B1
(45) **Date of Patent: *Mar. 13, 2001**

(54) POST-DYE SCREEN PRINTING

(75) Inventors: Samuel B. Moore; Yonghua Li, both of Burlington, NC (US)

(73) Assignee: Burlington Chemical Co., Inc., Burlington, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/260,841

(22) Filed: Mar. 2, 1999

(51) Int. Cl.[7] ..... C08K 5/15; D06P 5/00
(52) U.S. Cl. ..... 524/56; 8/478; 8/483
(58) Field of Search ..... 524/56; 8/478, 8/483

(56) References Cited

U.S. PATENT DOCUMENTS

| | | | |
|---|---|---|---|
| 3,907,737 | 9/1975 | Marx et al. | 260/29.6 |
| 4,110,230 | 8/1978 | Hessert et al. | 252/855 |
| 4,276,207 | 6/1981 | Lester et al. | 260/17 |
| 4,585,820 | 4/1986 | Defago et al. | 524/232 |
| 5,984,977 * | 11/1999 | Moore et al. | 8/478 |

OTHER PUBLICATIONS

Article entitled Printing on Cellulose from Textile Printing; ;1995.

"Nylon Technology" from Textile Technology Series; McGraw–Hill Book Co., Inc. Jan. 1953.

"Glossary" from the Thames andn Hudson Manual of Textile Printing; 1974.

"Clamp Reisit dyeing of Fabrics" Calico Museum of Textiles, 1977.

* cited by examiner

*Primary Examiner*—Kriellion Sanders
(74) *Attorney, Agent, or Firm*—Rhodes & Mason, PLLC

(57) ABSTRACT

A dyeing system composition for use in printing articles formed from cellulose prior to dyeing. The dyeing system composition includes the use of both a dye blocking print paste and a dye enhancing print paste to selectively decrease or increase the shade of dyed portions of a cellulose article such as a woven cotton fabric.

68 Claims, No Drawings

POST-DYE SCREEN PRINTING

BACKGROUND OF THE INVENTION

1. Field of the Invention

The present invention relates generally to printing cellulosic articles and, more particularly, to a new and improved method of screen printing fabrics, in which the fabric article is first selectively printed with a chemical system including a dye blocking print paste and a dye enhancing print paste and subsequently dyed to bring out the print.

2. Description of the Prior Art

Traditional screen printing of garments is done by printing ink, binder, thickener and softener combinations on dyed or white prepared for print (PFP) garments. A detailed description of the screen printing process is published in the Encyclopedia of Textiles, Second Edition, 1972 Prentice-Hall, Inc., Englewood Cliffs N.J., the disclosure of which is hereby incorporated by reference in its entirety. The following discussion is taken from the above-referenced Encyclopedia of Textiles.

The screen printing method in textiles is basically a stencil process. A wooden or metal frame is covered with a bolting cloth, which may be made of silk, fine metal thread, or nylon. The fabric is covered with a film and the design areas are cut out of the film just as in stencil making. The frame is then laid on the fabric and color is brushed or squeezed through the open areas of the film by the use of a big rubber knife or squeegee.

Originally, the design was cut out of film and then adhered to the screen. Today the cutting is done mechanically by a photo-chemical process which reproduces the design exactly as it was painted in the art which is being reproduced.

In printing, one screen is used for each color and these are accurately registered one on the other by the use of fixed stops attached to an iron rail running the length of the table. The length of the table determines the number of yards which can be printed at one laying; this varies depending on the available space, though 30 yards is considered the smallest space which is practical for economic production.

While screen printing, either by hand or machine, is a slower and more expensive process than roller printing, it has several virtues. From the point of view of design, pattern repeats can be much larger than in roller printing. Also, since the process is slower, pigment colors can be laid on in heavy layers to produce a handicraft effect. From an economic point of view, it does not require as large an investment as roller printing because the runs can be shorter, especially in the hand operation. This has encouraged smaller converters to adopt the screen method and to experiment more with design than they would be able to do in the roller method, where they would be required to contract for a minimum of about 8000 yards per pattern.

One of the most important physical parameters for good screen printing is that the print paste is thick enough to stand in a gel state until it is dried and cured. This assures clean crisp definition of the print. However, the print paste still must flow readily and evenly. These two properties are defined as the rheology of the print paste and the most desirable property is called pseudo-plastic or the ability of the paste to become less viscous when moved by pump or mechanical device and to thicken or become more viscous when it stills.

Because of the nature of the print paste, screen prints are generally opaque and rubbery to the touch. In addition, these prints are not very durable especially when washed. There has been much work done in developing softer prints that do not crack and peel after washing and these softened prints are called"plastisols," but they are still based on pigments, binder, thickener and are still a surface coating which can be "felt".

One approach to solving this problem is disclosed in U.S. patent application Ser. No. 08/922,221, filed Sep. 2, 1997, now U.S. Pat. No. 5,984,977, which is hereby incorporated by reference in its entirety. However, some dye sites may still remain when using the teachings in this application. These sites may be sufficient to prevent multiple color dyeing since small traces of dyes may make true colors more difficult to achieve.

Thus, there remains a need for a new and improved method of screen printing in which the garment or fabric may be printed using traditional screen printing techniques while, at the same time, provides printed areas which can not be rubbed off or felt to the touch.

SUMMARY OF THE INVENTION

The present invention is directed to a dyeing system composition for use in printing articles or fabrics formed from cellulose prior to dyeing. In the preferred embodiment, the dyeing system composition includes the selective use of both a dye blocking print paste and a dye enhancing print paste to selectively decrease or increase the shade of the dyed portions of a cellulose article, such as a woven or knitted cotton or cotton/polyester article or fabric.

In the preferred embodiment, the dye blocking print paste includes a thickener and dye blocking agents. The dye blocking agents includes an ether-forming cross-linking resin, which may be pre-catalyzed, an ester-forming cross-linking resin, a reductive catalyst and a dye resist. Also, in the preferred embodiment, the dye enhancing print paste includes a thickener and an epoxy functional quaternary ammonium enhancing agent. The thickener for both print pastes, preferably, is an acid/alkali stable hydroxypropyl guar derivative, polyscaharride, dispersed in an invert emulsion.

Accordingly, one aspect of the present invention is to provide a dye blocking print paste for use in printing articles formed from cellulose prior to dyeing. The composition includes: (a) a thickener; and (b) dye blocking agents, the dye blocking agents including an ether-forming, cross-linking resin, an ester-forming, cross-linking resin, a catalyst and a dye resist.

Another aspect of the present invention is to provide a dye blocking print paste for use in printing articles formed from cellulose prior to dyeing. The composition includes: (a) a thickener; and (b) dye blocking agents, the dye blocking agents including a pre-catalyzed, ether-forming, cross-linking resin, an ester-forming, cross-linking resin, a catalyst and a dye resist.

Still another aspect of the present invention is to provide a dyeing system composition for use in printing articles formed from cellulose prior to dyeing. The composition includes: (a) a dye blocking print paste, the dye blocking print paste including: (i) a thickener and (ii) dye blocking agents, the dye blocking agents including a pre-catalyzed, ether-forming, cross-linking resin, an ester-forming, cross-linking resin, a catalyst and a dye resist; and (b) a dye enhancing print paste, the dye enhancing print paste including: (i) a thickener and (ii) an enhancing agent.

These and other aspects of the present invention will become apparent to those skilled in the art after a reading of the following description of the preferred embodiment when considered with the examples.

DESCRIPTION OF THE PREFERRED EMBODIMENTS

The present invention is performed in the reverse order of traditional garment or fabric screen printing. According to the present invention, the garment or fabric is print prepared (e.g. scoured and bleached white) or griege (unprepared) with a chemical system including a dye blocking print paste and a dye enhancing print paste. The dye blocking print paste includes a wetting agent, a thickener paste; and a dye blocking agent, the dye blocking agent including a cross-linking resin and a dye resist to selectively decrease the shade of the dye. In the preferred embodiment, the dye enhancing print paste includes a wetting agent, thickener and a dye enhancing agent which is used to selectively increase the shade of the dye.

In the preferred embodiment, the thickener paste for both the dye blocking and the dye enhancing print paste is an acid/alkali stable hydroxypropyl guar derivative, polyscaharride, dispersed in an invert emulsion. Specifically, the polysaccharide concentrate includes about 35 weight percent water, 10 weight percent emulsifier, 10 weight percent polysaccharide and 45 weight of a petrol solvent.

Also, the cross-linking resin used in the dye blocking agent is preferably a pre-catalyzed glyoxal resin although it is believed that a self-catalyzed glyoxal resin might also work. In the preferred embodiment, the dye resist used in the dye blocking agent is a low molecular weight polyacrylic acid having a molecular weight of about 2000. One suitable dye resist is sold under the tradename BURCO® Dye Resist 118 by Burlington Chemical Company, Inc. of Burlington, N.C., the assignee of the present invention.

Finally, the enhancing agent used in the dye enhancing print paste is preferably an epoxy functional quaternary ammonium compound. One suitable dye enhancer is sold under the tradename BURCO® DCE by Burlington Chemical Company, Inc. of Burlington, N.C., the assignee of the present invention.

The cellulosic article, garment or fabric is then dyed to the desired shade with the blocking and enhancing print pastes selectively either reducing the amount of dye on the fabric or enhancing the dye on the fabric. If we measure the background and set it arbitrarily as 100%, the enhanced regions are 250% deeper in color and the blocked regions are 90% lighter than the background.

Further examples of the present invention can be seen in a camo print on 100% cotton knit fabric where various concentrations of the enhancer chemical are printed on and then dyed.

The present invention can be best understood by a review of the following examples:

EXAMPLES 1–2

A dye blocking print paste was prepared using both pre-catalyzed glyoxal resin and a conventional glyoxal resin according to the amounts in weight percent shown in Table 1. Cotton fabric was printed with the dye blocking print paste, the print paste was allowed to dry and cure and conventional reactive and direct dyeing were made. The results are shown in Table 1, below:

TABLE 1

| Ex. | Pas | Pre-Catalyzed Glyoxal Resin | Glyoxal Resin | Poly-Acrylic Acid | Wetting Agent | Shade Difference |
|---|---|---|---|---|---|---|
| 1 | 15 w | 15 wt. % | — | 5 wt. % | 0.1 wt. % | −90% |
| 2 | 15 w | — | 15 wt. % | 5 wt. % | 0.1 wt/ % | No Effect! |

As can be seen, only the dye blocking print paste including a pre-catalyzed glyoxal resin was effective in blocking the dye.

EXAMPLES 3–6

A dye blocking print paste was prepared using pre-catalyzed glyoxal resin according to the amounts in weight percent shown in Table 2. Cotton fabric was printed with the dye blocking print paste, the print paste was allowed to dry and cure and conventional reactive and direct dyeing were made. The results are shown in Table 2, below:

TABLE 2

| Ex. | Pas te | Pre-Catalyzed Glyoxal Resin | Glyoxal Resin | Poly-Acrylic Acid | Wetting Agent | Shade Difference |
|---|---|---|---|---|---|---|
| 3 | 15 wt. % | 15 wt. % | — | 5 wt. % | 0.1 wt. % | −90% |
| 4 | 15 wt. % | 10 wt. % | — | 5 wt. % | 0.1 wt. % | −60% |
| 5 | 15 wt. % | 5 wt. % | — | 5 wt. % | 0.1 wt. % | −30% |
| 6 | 15 wt. % | 2.5 wt. % | — | 5 wt. % | 0.1 wt. % | −10% |

As can be seen, the dye blocking print paste having between about 5 to 15 wt. % pre-catalyzed glyoxal resin produced a linear relationship between the weight percent of resin and the shade difference in blocking the dye.

EXAMPLES 7–10

A dye blocking print paste was prepared using pre-catalyzed glyoxal resin according to the amounts in weight percent shown in Table 3 and both with and without poly-acrylic acid. Cotton fabric was printed with the dye blocking print paste, the print paste was allowed to dry and cure and conventional reactive and direct dyeing were made. The results are shown in Table 3, below:

TABLE 3

| Ex. | Pas te | Pre-Catalyzed Glyoxal Resin | Glyoxal Resin | Poly-Acrylic Acid | Wetting Agent | Shade Difference |
|---|---|---|---|---|---|---|
| 7 | 15 wt. % | 15 wt. % | — | 5 wt. % | 0.1 wt. % | −90% |
| 8 | 15 wt. % | 15 wt. % | — | — | 0.1 wt. % | −60% |
| 9 | 15 wt. % | 2.5 wt. % | — | — | 0.1 wt. % | No Effect! |
| 10 | 15 wt. % | — | — | 15 wt. % | 0.1 wt. % | No Effect! |

As can be seen, the addition of polyacrylic acid improved the effectiveness of the dye blocking print paste 50% when comparing Example 7 to Example 8. In addition, only the dye blocking print paste including a pre-catalyzed glyoxal resin was effective in blocking the dye even when the amount of polyacrylic acid was increase to 15 wt. %.

Dyeings were than made using the thickener of the present invention along with a conventional epoxy functional quaternary ammonium compound to form a dye enhancing print paste. This compound has been used in the past to react with cellulose to yield a permanent cationic site on the cellulose to improve dye yield. If we measure the background and set it arbitrarily as 100%, the enhanced regions were 250% deeper in color than the background when dyed with fiber reactive and direct dyes.

Finally, fabric was screen printed using a combination of the blocking print paste and enhancing print paste according to the present invention. Dyeing to the desired shade with the blocking and enhancing print pastes selectively either reduced the amount of dye on the fabric or enhanced the dye on the fabric. If we measure the background and set it arbitrarily as 100%, the enhanced regions were 250% deeper in color and the blocked regions were 90% lighter than the background!

In a further improved embodiment as claimed in the present invention, the dye blocking agents may include a pre-catalyzed ether-forming cross-linking resin, an ester-forming cross-linking resin, a catalyst and a dye resist. It has been discovered that the addition of an ester-forming cross-linking resin and catalyst improves the strength, the light scattering (KS value) and further reduces the excluded dye sites of the resist portion of the fabric as shown below.

EXAMPLES 11–13

Dye blocking print pastes were prepared using a thickener and different dye blocking agents and a dye resist. The dye blocking agents included only a pre-catalyzed, ether-forming, cross-linking resin; only an ester-forming, cross-linking resin and a catalyst; and the combination of a pre-catalyzed, ether-forming, cross-linking resin, an ester-forming, cross-linking resin, and a catalyst. Cotton fabric was printed with the dye blocking print paste, the print paste was allowed to dry and cure and conventional reactive and direct dyeing were made. The results are shown in Table 4, below:

TABLE 4

| Ex. | Dye Blocking Agent | Fabric Strength (compared to untreated fabric) | Light Scatter (KS value) | Excluded Dye Sites |
|---|---|---|---|---|
| 11 | Pre-Catalyzed Ether-forming, cross linking Resin (only) | 60% | 100% (base) | 98% |
| 12 | Ester-forming, cross linking Resin (only) | 100% | 70% | 97% |
| 13 | Both resins (present invention) | 100% | 140% | 99% |

As can be seen, the dye blocking print paste including the additional cross-linking resin and catalyst is a significant improvement.

In the preferred embodiment, the ester-forming cross-linking resin are carboxylic acids. Specifically, the resin is a 50/50 mixture of polymaleic acid and butanetetracarboxylic acid at between about 5 to 15 weight percent of the total weight of the dye blocking print paste with about 8 weight percent of the total weight of the dye blocking print paste being preferred.

Also, in the preferred embodiment, the catalyst is reductive with sodium hypophosphite at a 1 to 4 ratio to the ester-forming cross-linking resin being preferred.

A cellulosic article, garment or fabric dyed to the desired shade with the improved blocking print paste further reduces the amount of dye on the fabric. If we measure the background and set it arbitrarily as 100%, the enhanced regions are still 250% deeper in color and the improved blocked regions are 98% lighter than the background.

Certain modifications and improvements will occur to those skilled in the art upon a reading of the foregoing description. By way of example, while the preferred embodiment of this invention is directed to printing cotton and cotton/polyester fabrics, it could be easily adapted to printing other cellulosic articles. Also, non-polymer organic acids, such as citric acid, maleic acid and BTCA, other cationics and other thickeners may work. It should be understood that all such modifications and improvements have been deleted herein for the sake of conciseness and readability but are properly within the scope of the following claims.

We claim:

1. A dye blocking print paste for use in printing articles formed from cellulose prior to dyeing, said composition comprising:

(a) a thickener; and (b) dye blocking agents, said dye blocking agent including an ether-forming, cross-linking resin, an ester-forming, cross-linking resin, a catalyst and a dye resist.

2. The composition according to claim 1, further including a dye enhancing print paste, said dye enhancing print paste including a thickener and an enhancing agent.

3. The composition according to claim 2, wherein said thickener for said dye enhancing print paste is an alkali stable concentrate.

4. The composition according to claim 3, wherein said alkali stable concentrate is stable between a pH, range of about 7.5 to 10.0.

5. The composition according to claim 3, wherein said alkali stable concentrate is a polysaccharide.

6. The composition according to claim 2, wherein said thickener for said dye enhancing print paste is about 15 weight percent of the total weight of said dye enhancing print paste.

7. The composition according to claim 2, wherein said enhancing agent is a cationizing polymer.

8. The composition according to claim 7, wherein said cationizing polymer is between about 1 to 10 weight percent of the total weight of said dye enhancing print paste.

9. The composition according to claim 7, wherein said cationizing polymer is an epoxy functional quaternary ammonium compound.

10. The composition according to claim 7, wherein said cationizing polymer further includes an alkali donor.

11. The composition according to claim 2, wherein said dye enhancing print paste further includes a wetting agent.

12. The composition according to claim 11, wherein said wetting agent is about 0.1 weight percent of the total weight of said dye enhancing print paste.

13. A dye blocking print paste for use in printing articles formed from cellulose prior to dyeing, said composition comprising:

(a) a thickener; and (b) dye blocking agents, said dye blocking agent including a pre-catalyzed, ether-forming, cross-linking resin, an ester-forming, cross-linking resin, a catalyst and a dye resist.

14. The composition according to claim 13, wherein said thickener for said dye blocking print paste is an acid stable concentrate.

15. The composition according to claim 14, wherein said acid stable concentrate is stable between a pH range of about 6.5 to 3.5.

16. The composition according to claim 14, wherein said acid stable concentrate is a polysaccharide.

17. The composition according to claim 16, wherein said polysaccharide acid stable concentrate includes about 35 weight percent water, 10 weight percent emulsifier, 10 weight percent polysaccharide and 45 weight of a petrol solvent.

18. The composition according to claim 13, wherein said thickener for said dye blocking print paste is about 15 weight percent of the total weight of said dye blocking print paste.

19. The composition according to claim 13, wherein said pre-catalyzed, ether-forming cross-linking resin is between about 5 to 15 weight percent of the total weight of said dye blocking print paste.

20. The composition according to claim 13, wherein said pre-catalyzed, ether-forming cross-linking resin is a pre-catalyzed glyoxal resin.

21. The composition according to claim 13, wherein said dye resist is an anionic polymer.

22. The composition according to claim 21, wherein said anionic polymer is between about 0 to 5 weight percent of the total weight of said dye blocking print paste.

23. The composition according to claim 21, wherein said anionic polymer is polyacrylic acid.

24. The composition according to claim 23, wherein said polyacrylic acid is a low molecular weight acid having a molecular weight of about 2000.

25. The composition according to claim 13, wherein said dye blocking print paste further includes a wetting agent.

26. The composition according to claim 25, wherein said wetting agent is about 0.1 weight percent of the total weight of said dye blocking print paste.

27. The composition according to claim 13, wherein said ester-forming cross-linking resin is a carboxylic acid.

28. The composition according to claim 27, wherein said carboxylic acid is a 50/50 mixture of polymaleic acid and butanetetracarboxylic acid.

29. The composition according to claim 13, wherein said ester-forming cross-linking resin is between about 5 to 15 weight percent of the total weight of said dye blocking print paste.

30. The composition according to claim 29, wherein said ester-forming cross-linking resin is about 8 weight percent of the total weight of said dye blocking print paste.

31. The composition according to claim 13, wherein said catalyst is reductive.

32. The composition according to claim 31, wherein said catalyst is sodium hypophosphite.

33. The composition according to claim 32, wherein said catalyst is about a 1 to 4 ratio to said ester-forming cross-linking resin.

34. A dyeing system composition for use in printing articles formed from cellulose prior to dyeing, said composition comprising:

(a) a dye blocking print paste, said dye blocking print paste including: (i) a thickener and (ii) dye blocking agents, said dye blocking agents including a pre-catalyzed, ether-forming, cross-linking resin, an ester-forming, cross-linking resin, a catalyst and a dye resist; and (b) a dye enhancing print paste, said dye enhancing print paste including: (i) a thickener and (ii) an enhancing agent.

35. The composition according to claim 34, wherein said thickener for said dye enhancing print paste is an alkali stable concentrate.

36. The composition according to claim 35, wherein said alkali stable concentrate is stable between a pH range of about 7.5 to 10.0.

37. The composition according to claim 35, wherein said alkali stable concentrate is a polysaccharide.

38. The composition according to claim 34, wherein said thickener for said dye enhancing print paste is about 15 weight percent of the total weight of said dye enhancing print paste.

39. The composition according to claim 34, wherein said enhancing agent is a cationizing polymer.

40. The composition according to claim 39, wherein said cationizing polymer is between about 1 to 10 weight percent of the total weight of said dye enhancing print paste.

41. The composition according to claim 39, wherein said cationizing polymer is an epoxy functional quaternary ammonium compound.

42. The composition according to claim 39, wherein said cationizing polymer further includes an alkali donor.

43. The composition according to claim 34, wherein said dye enhancing print paste further includes a wetting agent.

44. The composition according to claim 43, wherein said wetting agent is about 0.1 weight percent of the total weight of said dye enhancing print paste.

45. The composition according to claim 34, wherein said thickener for said dye blocking print paste is an acid stable concentrate.

46. The composition according to claim 45, wherein said acid stable concentrate is stable between a pH range of about 6.5 to 3.5.

47. The composition according to claim 45, wherein said acid stable concentrate is a polysaccharide.

48. The composition according to claim 47, wherein said polysaccharide acid stable concentrate includes about 35 weight percent water, 10 weight percent emulsifier, 10 weight percent polysaccharide and 45 weight of a petrol solvent.

49. The composition according to claim 34, wherein said thickener for said dye blocking print paste is about 15 weight percent of the total weight of said dye blocking print paste.

50. The composition according to claim 34, wherein said pre-catalyzed, ether-forming cross-linking resin is between about 5 to 15 weight percent of the total weight of said dye blocking print paste.

51. The composition according to claim 34, wherein said pre-catalyzed, ether-forming cross-linking resin is a pre-catalyzed glyoxal resin.

52. The composition according to claim 34 wherein said dye resist is an anionic polymer.

53. The composition according to claim 52, wherein said anionic polymer is between about 0 to 5 weight percent of the total weight of said dye blocking print paste.

54. The composition according to claim 52, wherein said anionic polymer is polyacrylic acid.

55. The composition according to claim 54, wherein said polyacrylic acid is a low molecular weight acid having a molecular weight of about 2000.

56. The composition according to claim 34, wherein said dye blocking print paste further includes a wetting agent.

57. The composition according to claim 56, wherein said wetting agent is about 0.1 weight percent of the total weight of said dye blocking print paste.

58. The composition according to claim 34, wherein said ester-forming cross-linking resin is a carboxylic acid.

59. The composition according to claim 58, wherein said carboxylic acid is a 50/50 mixture of polymaleic acid and butanetetracarboxylic acid.

60. The composition according to claim 34, wherein said ester-forming cross-linking resin is between about 5 to 15 weight percent of the total weight of said dye blocking print paste.

61. The composition according to claim 60, wherein said ester-forming cross-linking resin is about 8 weight percent of the total weight of said dye blocking print paste.

62. The composition according to claim 34, wherein said catalyst is reductive.

63. The composition according to claim 62, wherein said catalyst is sodium hypophosphite.

64. The composition according to claim 63, wherein said catalyst is about a 1 to 4 ratio to said ester-forming cross-linking resin.

65. A method for printing articles formed from cellulose, said method comprising the steps of:

(a) printing the article with a dye blocking print paste, said composition comprising: a thickener; and dye blocking agents, said dye blocking agents including an ether-forming, cross-linking resin, an ester-forming, cross-linking resin, a catalyst and a dye resist; and (b) dyeing the article.

66. A method for printing articles formed from cellulose, said method comprising the steps of:

(a) printing the article with a dye blocking print paste, said composition comprising: a thickener; and dye blocking agents, said dye blocking agents including a pre-catalyzed ether-forming, cross-linking resin, an ester-forming, cross-linking resin, a catalyst and a dye resist; and (b) dyeing the article.

67. A method for printing articles formed from cellulose, said method comprising the steps of:

(a) printing the article with a dye blocking print paste, said composition comprising: a thickener; and dye blocking agents, said dye blocking agents including a pre-catalyzed ether-forming, cross-linking resin, an ester-forming, cross-linking resin, a catalyst and a dye resist;

(b) printing the article with a dye enhancing print paste, said dye enhancing print paste including: (i) a thickener and (ii) an enhancing agent; and (c) dyeing the article.

68. An article formed from cellulose and printed with a dye blocking print paste prior to dyeing, said dye blocking print paste including: (a) a thickener; and (b) dye blocking agents, said dye blocking agent including an ether-forming, cross-linking resin, an ester-forming, cross-linking resin, a catalyst and a dye resist.

* * * * *